United States Patent [19]

Gigliotti, Jr. et al.

[11] 4,031,945

[45] * June 28, 1977

[54] PROCESS FOR MAKING CERAMIC MOLDS HAVING A METAL OXIDE BARRIER FOR CASTING AND DIRECTIONAL SOLIDIFICATION OF SUPERALLOYS

[75] Inventors: Michael F. X. Gigliotti, Jr., Scotia; Charles D. Greskovich, Schenectady, both of N.Y.

[73] Assignee: General Electric Company, Schenectady, N.Y.

[ * ] Notice: The portion of the term of this patent subsequent to Aug. 3, 1993, has been disclaimed.

[22] Filed: Apr. 7, 1976

[21] Appl. No.: 674,548

[52] U.S. Cl. ..... 164/72; 164/121; 164/138

[51] Int. Cl.[2] ..... B22D 21/06

[58] Field of Search ..... 164/14, 25, 41, 72, 164/138, 121

[56] References Cited

UNITED STATES PATENTS

| | | | |
|---|---|---|---|
| 3,743,003 | 7/1973 | Brown | 164/72 X |
| 3,779,816 | 12/1973 | Woo | 164/138 X |
| 3,802,482 | 4/1974 | Phipps, Jr. | 164/72 |
| 3,824,113 | 7/1974 | Loxley et al. | 164/72 X |
| 3,972,367 | 8/1976 | Gigliotti, Jr. et al. | 164/138 X |

*Primary Examiner*—Ronald J. Shore
*Attorney, Agent, or Firm*—Donald M. Winegar; Joseph T. Cohen; Jerome C. Squillaro

[57] ABSTRACT

At least one element of a superalloy cast into a refractory oxide-silica investment mold is oxidized to form a metal oxide barrier layer at the mold-metal interface to permit directional solidification of the cast superalloy at elevated temperatures without metal-mold reaction.

23 Claims, 3 Drawing Figures

FIG. 3

PROCESS FOR MAKING CERAMIC MOLDS HAVING A METAL OXIDE BARRIER FOR CASTING AND DIRECTIONAL SOLIDIFICATION OF SUPERALLOYS

BACKGROUND OF THE INVENTION

1. Field of the Invention

This invention relates to a process for forming barrier layers at the mold-metal interface of investment molds for casting and directional solidification of superalloys herein.

2. Background of the Invention

Shell molds for precision casting of steel and superalloy parts are, in general, composed of refractory oxide particles bonded together by a silica or phosphate gel. Such molds are generally formed by the lost wax process wherein a wax pattern is immersed repeatedly in a liquid slurry of the refractory oxide particles in a silica- or phosphate-bearing binder. Sufficient time is provided between immersions to allow the slurry coat to partially or completely dry on the wax. After a sufficient thickness of ceramic has built up on the wax, the wax is removed by chemical dissolution or melting in a steam autoclave or in a furnace. The mold is then fired, typically at 1000° C for 1 hour, to give it sufficient strength to withstand the casting process.

Chemical reactions between the mold and the cast metal are a minor problem in conventional casting due to relatively low temperatures and short times that the mold is in contact with the molten metal. However, for the plane front solidification of eutectic superalloys, severe metal-mold reactions frequently occur. These are due to the long contact time (up to 30 hours) of molten metal with the mold, the high temperature (~ 1800° C) required in the casting process to enable high growth rates during solidification, and high concentration of reactive elements in the superalloys such as carbon, aluminum, and titanium. In particular, attempts to cast tantalum carbide-reinforced eutectic superalloys with high nickel content in standard shell molds results in such a severe loss of carbon that the tantalum carbide reinforcing phase is absent from the final cast microstructure, producing a useless casting.

The mold-associated cause of this reaction is the silica phase (5–15 Wt%) present in the shell mold. Silica has a small negative free energy of formation and is reduced by the reactive elements in the eutectic superalloys.

With reference to FIG. 1, when NiTaC-13, a monocarbide reinforced superalloy, is cast in mold 10, an example of the prior art, a reaction occurs between the cast metal and the silica phase of the mold. The result of this reaction is the bright phase denoted by the reference numeral 12 which is NiTaC-13 metal penetrated into the mold and reacted with the silica phase of the mold. The resultant casting is defective due to decarburization of the cast alloy and because of poor surface finish.

Other prominent features in FIG. 1 include plastic mounting media 14, coarse backup grains 16 of alumina from the fluidized bed employed for the application of a sand coat between layers of mold materials, pores or voids 18 in the mold structure which result because of material pullout during polishing, or an actual void in the mold structure, and undissolved alumina 20 of one of the flours comprising the material composition.

Other features shown are mullite 22, light grey in color; a silica rich liquid phase 24 (in the mullite 22), dark gray in color; and small grains 26 of flour of alumina material of the face coat. There is no barrier layer present at what may be termed the interface between the mold and the cast metal.

In our copending patent applications, U.S. Ser. Nos. 586,035 and 586,048, now Pat. No. 3,959,013, we describe how a barrier layer may be formed at the interface between the mold and the cast metal. As illustrated in FIG. 2, the barrier layer 100 is present at the interior wall surfaces of the mold. The interior wall surfaces define the cavity in the mold into which the metal is cast for directional solidification. Coarse grains 102 of alumina from the sand coat of the mold are present. Fine grains 104 of alumina are principally from the alumina flour mixture of the face coating. Bright spots 106 are small metal alloy inclusions in the protective alumina barrier layer 100. Dark area 108 are voids or holes occuring as a result of grain pullouts during polishing of the specimen. Light gray areas 110 are plastic mounting material representative of the porosity in the mold structure after casting and solidification of a superalloy in a mold resulting from the reduction of the silica binder material.

It was our belief that the barrier could only be formed in place by reducing the silica of the mold and obtain a microstructure of the mold in the vicinity of the cavity into which the superalloy is cast which shows a substantial absence of silica between the grains of another refractory oxide comprising the material of the mold. We have now discovered this condition of the mold does not have to exist in order to obtain the barrier layer. A barrier layer can be formed wherein the prior art porous structure is now absent and a substantially solid structure backs up the layer.

It is an object of this invention to provide a new and improved method to form a barrier layer at the mold-metal interface of an investment mold employed for the casting and the directional solidification of a melt of a superalloy therein which overcomes the deficiencies of the prior art.

Another object of this invention is to provide a new and improved method for forming a barrier layer at the mold-metal interface of an investment mold employed for the casting and the directional solidification of a melt of a superalloy therein by the oxidation of at least one element, or constituent, of the superalloy material composition.

A further object of this invention is to provide a new and improved method for forming a barrier layer at the mold-metal interface of an investment mold employed for the casting and the directional solidification of a melt of a superalloy therein, the microstructure of the mold in the vicinity of, and in contact with, the barrier layer exhibits a substantially porous free structure and the material comprising the same contains silica bearing phases therein in contact with the barrier layer.

Other objects of this invention will, in part, be obvious and will, in part, appear hereinafter.

BRIEF DESCRIPTION OF THE INVENTION

In accordance with the teachings of this invention, there is provided a new and improved method for forming a barrier layer at the mold-metal interface of silica bonded alumina molds. The method includes means for forming the barrier by deriving substantially all of the material comprising the same from the melt cast in the cavity of the mold. Heating of the mold, casting of the melt and directional solidification of the melt is accomplished in a controlled prevailing atmosphere. The controlled prevailing atmosphere is one which is oxidizing for at least one constituent of the composition of the superalloy. The loss of the at least one constituent is minimal and has no appreciable effect on the physical characteristics of the resulting casting.

The structure of the mold in physical contact with the barrier layer at the mold-metal interface is characterized by the presence of silica bearing phases in contact with the barrier layer.

The barrier layer has a thickness which is sufficient to prevent the melt of superalloy material from penetrating the layer and physically contacting the mold material. A thickness of greater than 1 micron, and at least 10 microns, is preferred.

DESCRIPTION OF THE INVENTION

Figure 1:
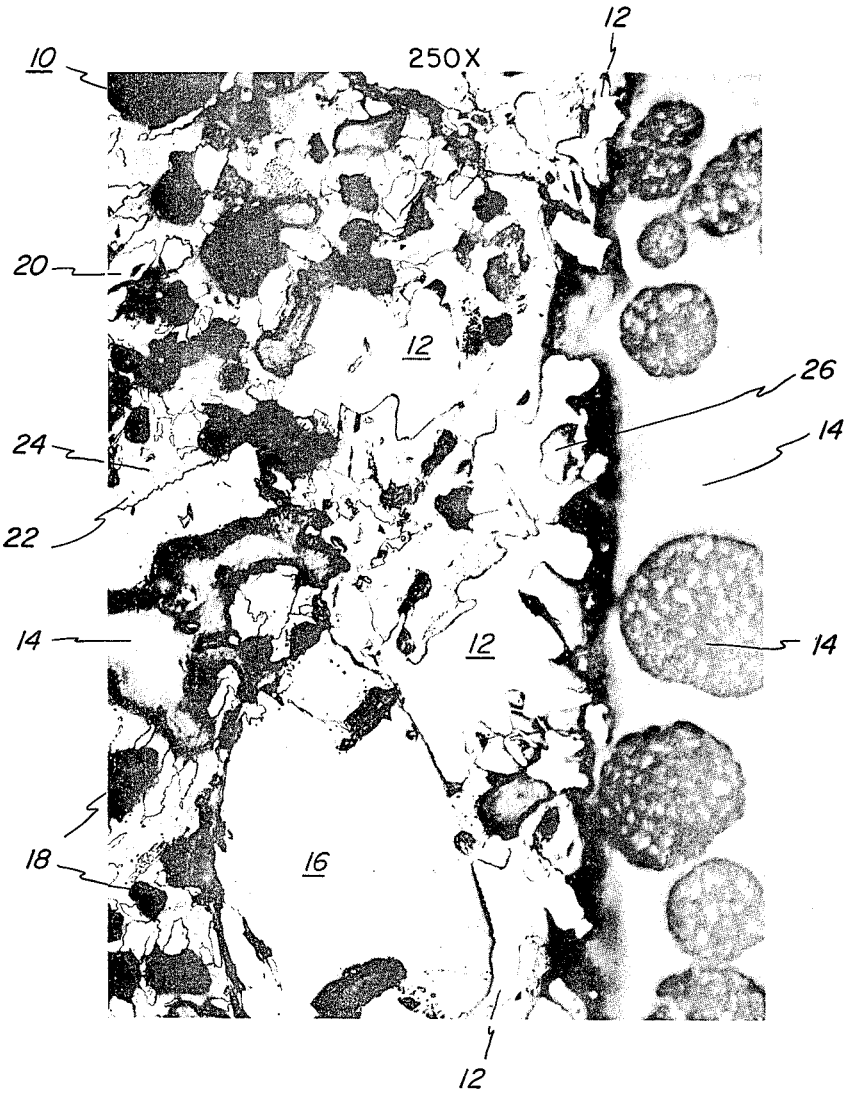
FIG. 1 PRIOR ART
FIG. 1 is a reflected light photomicrograph, at 250 ×, of a polished section of the reaction zone at the metal-mold interface of a prior art mold.
Figure 2:
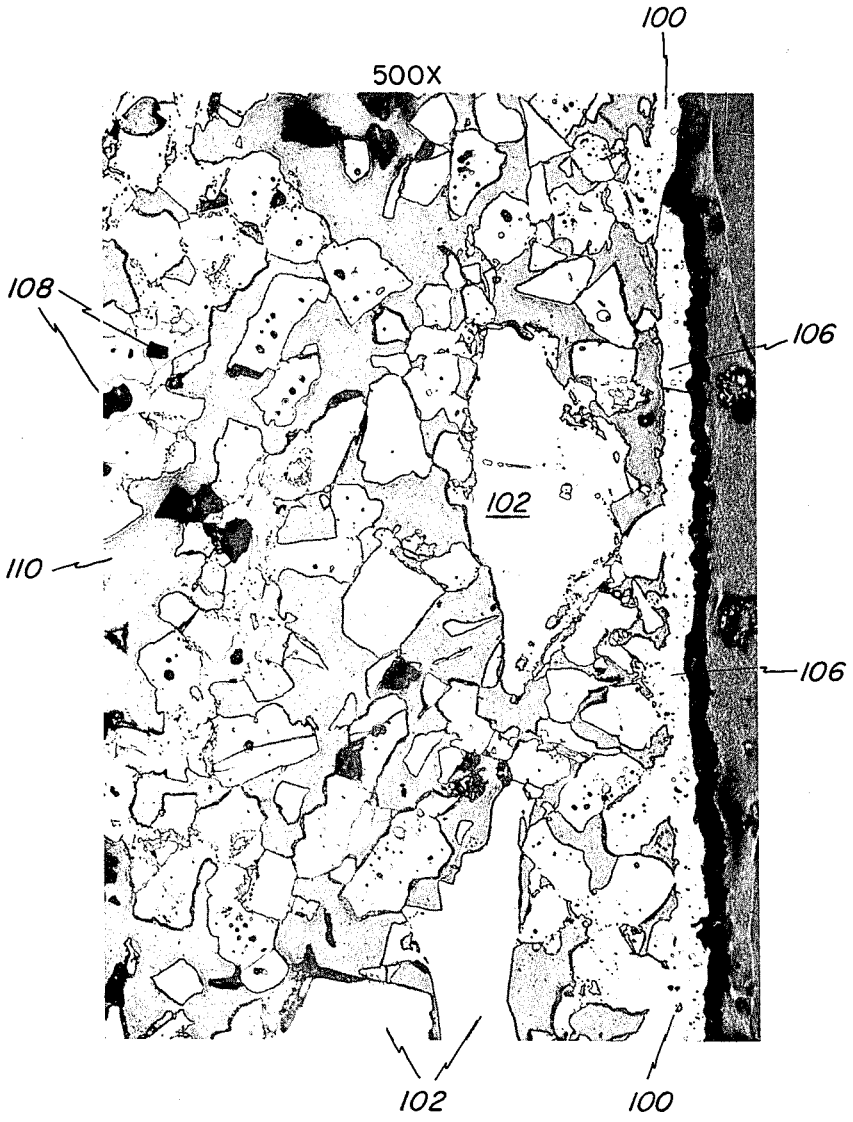
FIG. 2 PRIOR ART
FIG. 2 is a reflected light photomicrograph, at 500 ×, of a polished section of the barrier layer at the metal-mold interface of a prior art mold.
Figure 3:
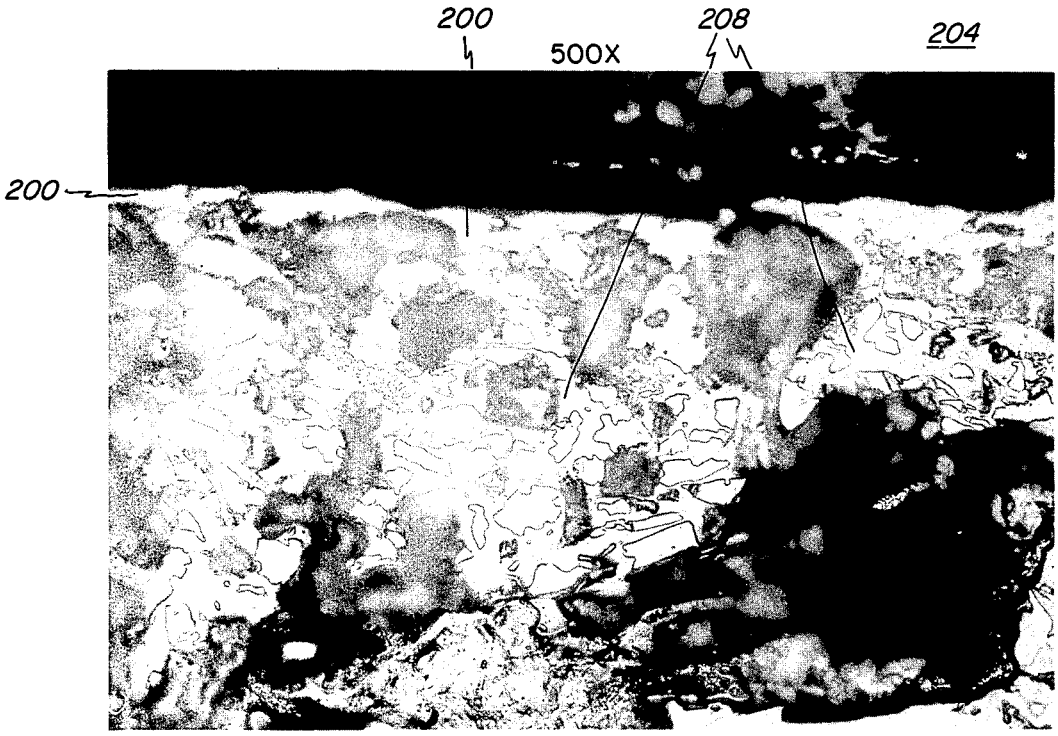
FIG. 3 is a reflected light photomicrograph, at 500 ×, of a polished section of the reaction zone at the metal-mold interface made in accordance with the teachings of this invention.

With reference to FIG. 3, there is shown a portion of a mold suitable for the casting and directional solidification of superalloys therein. A barrier layer 200 is present at the interior wall surfaces of the mold. The interior wall surfaces define the cavity in the mold into which metal is cast for directional solidification.

Other items identifiable in FIG. 3 are coarse grains 202 of alumina from a sand coat. Fine grains 204 of alumina are principally from the alumina flour mixture of the face coat. Bright spots are small metal alloy inclusions in the protective alumina barrier layer 200.

Dark areas 208 are voids are holes occurring as a result of grain pullouts during polishing of the specimen. Light gray areas 210 are silica bearing phases of either mullite or mullite and silica. It is to be noted that there is a substantial absence of porosity in the structure of the mold in contact with the barrier layer 200. The barrier layer 200 prevents the cast metal from seeing the silica phases of the mold.

The barrier layer 200 enables one to successfully cast planar front solidified eutectic superalloys which contain tantalum carbide as the reinforcing phase therein. The barrier layer 200 is supported by a mold microstructure which does not contain material which will attack the barrier layer 200 or the metal cast in the mold. The layer 200 may be as thin as possible, on the order of 1 micron, providing it prevents cast metal from penetrating the mold.

It is our belief that the barrier layer 200 is formed in situ by the oxidation of a small amount of a suitable constituent material from the melt to form the layer 200. In particular, the material may be aluminum to form an aluminum oxide barrier layer 200. The oxidation of the melt to form the layer 200 is carried out at an elevated temperature in a controlled prevailing furnace atmosphere. Preferably, the material of the barrier layer 200 comprises a refractory oxide.

The mold material composition may comprise alumina-silica, yttria-silica or magnesia-silica.

In order to describe the invention more fully and for no other purpose, the mold material is said to be of alumina with a silica binder.

We have found that the alumina-silica molds should be fired at an elevated temperature of from 1600° C to approximately 1850° C for a period of time of from one-fourth to 2 hours. Preferably, the molds are fired at approximately 1700° C ± 50° C for about 1 hour to obtain molds which exhibit excellent mold performance. These temperature ranges and periods of time at temperature are postulated on the need to have alumina contained in the silica phase of the mold material.

The mechanism of forming the layer 200 to protect the mold-metal surface interface includes the cast alloy as the provider of a constituent of the material of the layer 200. In the casting and directional solidification of an alloy of nickel, chromium, cobalt, aluminum, tungsten, rhenium, vanadium, tantalum and carbon, an alumina-silica investment mold is employed. The material of the layer 200 is alumina and is derived from the aluminum of the cast metal. It is believed that oxidation of a small amount of the aluminum from the eutectic alloy cast in the mold forms the aluminum oxide. The loss of aluminum from the cast metal alloy has been proven to be negligible as determined by chemical analysis of cast finished products.

A proposed mechanism which may be the cause of the formation of the barrier layer 200 is that the metal of the layer 200 is derived from the cast metal alloy and is oxidized by the prevailing furnace atmosphere. The metal oxide of the layer 200 is stabilized on the outside of the cast melt by surface tension. We have observed that it apparently is necessary for the prevailing furnace atmosphere to be slightly oxidizing with respect to the melt. The furnace atmosphere is most generally an inert gas such, for example, as argon, helium or any gas of Group VIII of the Periodic Table. The oxidizing atmosphere is achieved by introducing a predetermined amount of pure oxygen or an oxygen-bearing gas such, for example, as air, carbon monoxide and carbon dioxide into the gas, bubbling all or a portion of the inert gas through water maintained at a predetermined temperature and the like. Alternately, hydrogen or hydrogen embodying a predetermined amount of water vapor may also be employed as an oxidizing atmosphere.

It has been found that castings produced in molds of metal oxide-silica materials in a furnace atmosphere of substantially pure inert atmosphere are not acceptable for commercial products. However, a small amount of oxygen introduced into the same inert atmosphere produces castings of commercial quality. The amount of oxygen may comprise from about 0.01% to about 5% of the ambient or prevailing atmosphere. Argon with a dew point of 70° F has been found to be an excellent furnace atmosphere for practicing the novel process of this invention to produce the novel mold for casting superalloys. While higher oxygen contents above 10% may be utilized, problems associated with excessive slag formations will occur.

The following examples are illustrative of the teachings of this invention.

EXAMPLE I

Barrier Layer Formation in Our Copending Applications

A silica-bonded alumina shell mold of a material composition of about 94% by weight alumina and about 6% by weight silica was prepared in a manner described in the copending application of Paul Svec entitled "Process For Making an Investment Mold For Casting and Solidification of Superalloys Therein," Ser. No. 590,970 filed on June 27, 1975 and assigned to the same assignee as this invention, now U.S. Pat. No. 3,972,367. The shell mold was placed in a Bridgeman furnace and fired at about 1700° C ± 50° C for approximately 1 hour. Heating of the mold in the Bridgeman furnace was accomplished by a graphite susceptor and r.f. radiation. The prevailing furnace atmosphere was argon of commercial purity having a gas flow rate of from 2 to 3 $ft^3$ per hour. During the last 30 minutes of the heating cycle air was introduced into the furnace by aspiration through a small port of ¼ inch diameter in the furnace wall. The interior of the furnace had a volume of about 11 cubic feet. The amount of oxygen in the gas mixture was calculated to be about 3%.

A metal alloy was prepared having the following composition:

| | |
|---|---|
| Nickel | 63.4% |
| Chromium | 4.4% |
| Cobalt | 3.3% |
| Aluminum | 5.4% |
| Tungsten | 3.1% |
| Rhenium | 6.2% |
| Vanadium | 5.6% |
| Tantalum | 8.1% |
| Carbon | 0.48% |

The metal alloy was melted by heating to an elevated temperature of 1650° C ± 50° C. The metal alloy was cast into the mold. Planar front solidification of the cast metal alloy was then practiced. The solidification process was practiced for approximately 30 hours at an elevated temperature which was controlled between 1650° C and 1750° C.

Upon completing the solidification process stage, the casting was removed from the mold and both the mold and the casting were examined. The casting had excellent surface finish qualities. No severe reaction occurred between the casting and the mold material. Chemical analysis established the chemical composition of the solidified casting to be within the calculated limits desired. No loss of carbon and only a negligible loss of aluminum could be detected from the cast metal. The reinforcement eutectic fibers of approximately $Ta_{0.75}V_{0.25}C$ were present in the casting. The mold face in contact with the cast metal showed excellent surface qualities. A barrier layer of alumina had been formed at the mold-metal interface. Silica was absent in the mold material immediately behind, and in contact with, the barrier layer of alumina. The barrier was a thin irregular layer approximately 10 microns in thickness. The integrity of the barrier layer was sufficient however to produce an excellent casting.

EXAMPLE II

Example of Barrier Layer Formation In Our Copending Applications

The process of Example I was repeated except that the furnace for heating the mold and for planar front solidification of the alloy was an alumina tube heated resistively by molybdenum wire windings. The furnace chamber remained sealed allowing no air aspiration. The prevailing furnace atmosphere was argon — 10% by volume carbon monoxide. The alloy cast was a nickel, chrome, aluminum, cobalt, tungsten, rhenium, vanadium, tantalum and carbon composition.

The results of the examination of the casting and the mold were the same as formed before in Example I.

EXAMPLE III

The process of Example I was repeated except that the oxygen was introduced into the prevailing furnace atmosphere by bubbling the argon gas through water maintained at room temperature of 28° C.

The results of the examination of the casting and the mold were the same as before except silica phases were now present in contact with the barrier layer.

EXAMPLE IV

The process of Example I was repeated except that the mold was not prefired before casting metal into it and the furnace atmosphere was pure argon.

The resultant casting was so decarburized that the upper three quarters of the casting lacked reinforcing monocarbide fibers. Gross surface flaws caused by the chemical reaction between the metal and mold were present.

Examination of molds after processing the teachings of this invention has revealed several characteristics of the barrier layer 200. The barrier layer 200 extends substantially throughout the entire mold cavity of the mold except that no barrier layer 200 is present in the upper region of the mold, that is above the metal line in the mold cavity. Also, no barrier layer 200 appears to be present in the lower, or chill region, of the mold. The barrier layer 200 apparently extends only between the chill region and the metal line in the mold cavity.

Although we have described our invention relative to superalloys having aluminum in its metal composition, other superalloys of compositions not having aluminum therein may also be cast into the novel mold and directionally solidified therein. In particular, the superalloy composition may comprise other suitable materials such, for example, as magnesium, yttrium, hafnium, zirconium, and titanium. The second refractory oxide which forms the barrier layer 200 would then include oxide constituents from the superalloy metal melt of magnesium, yttrium, hafnium, zirconium and titanium, respectively, therein.

Whereas, calcium oxide could not be used with alloys containing aluminum because of the low temperature reaction between the two, calcium oxide may be present in the mold for the other superalloy compositions.

We claim:

1. A method for forming a barrier layer at the mold-metal interface in a mold suitable for the casting and directional solidification of superalloys therein including the process steps of:

placing a mold made of a material comprising a first refractory oxide bonded together by silica within a furnace;

introducing a controlled prevailing atmosphere into the furnace;

heating the mold in the controlled prevailing atmosphere at an elevated temperature for a sufficient period of time to dissolve some of the first refractory oxide into the silica;

casting a melt of superalloy metal into a cavity of the mold, and forming a barrier layer comprising a second refractory oxide by the oxidation of at least one constituent of the superalloy within the mold in integral contact with the first refractory oxide material, the barrier layer having a surface defining at least a portion of the interior wall surfaces of the cavity into which the superalloy melt is cast and comes into contact therewith, and having a thickness greater than 1 micron to substantially prevent the molten metal from penetrating into the mold structure and the microstructure of the mold in the vicinity of the cavity exhibiting a substantially porous free structure containing silica bearing phases therein in contact with the barrier layer.

2. The method of claim 1 wherein the thickness of the barrier layer so formed is at least 10 microns.

3. The method of claim 1 wherein the first refractory oxide is one selected from the group consisting of aluminum oxide, calcium oxide, yttrium oxide and magnesium oxide, and the compositon of the superalloy material is substantially free of aluminum.

4. The method of claim 3 wherein the composition of the mold is from approximately 80.0% to about 99.9% by weight aluminum oxide.

5. The method of claim 1 wherein the first and second refractory oxides are the same material.

6. The method of claim 5 wherein the first refractory oxide is one selected from the group consisting of an aluminum oxide, yttrium oxide, calcium oxide and magnesium oxide.

7. The method of claim 6 wherein the thickness of the barrier layer so formed is greater than about 1 micron.

8. The method of claim 7 wherein the thickness of the barrier layer so formed is greater than 10 microns.

9. The method of claim 1 wherein the second refractory oxide comprises material derived in part from the melt of metal cast into the cavity of the mold.

10. The method of claim 3 wherein the second refractory oxide comprises oxide constituents from the superalloy metal melt of at least one metal selected from the group consisting of magnesium, yttrium, hafnium, zirconium, and titanium.

11. The method of claim 9 wherein the second refractory oxide comprises oxide constituents from the superalloy metal melt and at least one metal selected from the group consisting of magnesium and yttrium.

12. The method of claim 2 wherein the first refractory oxide is one selected from the group consisting of aluminum oxide, yttrium oxide and magnesium oxide.

13. The method of claim 2 wherein the supplied prevailing atmosphere comprises a mixture of an inert carrier gas and a predetermined amount of an oxygen-bearing gas.

14. The method of claim 13 wherein the inert gas is argon.

15. The method of claim 13 wherein the supplied prevailing atmosphere is provided by introducing pure oxygen into the inert carrier gas.

16. The method of claim 15 wherein oxygen comprises from 0.01 to 5% of the gas mixture.

17. The method of claim 15 wherein the inert gas is argon.

18. The method of claim 13 wherein the prevailing atmosphere is provided by introducing water vapor into the inert carrier gas.

19. The method of claim 13 wherein the oxygen bearing gas is carbon monoxide.

20. The method of claim 19 including practicing the process step of heating the mold in the furnace with a graphite susceptor, and forming carbon monoxide to mix in the inert carrier gas by reacting the graphite of the susceptor with the oxygen-bearing gas in the prevailing atmosphere introduced into the furnace.

21. The method of claim 19 including practicing the process step prior to heating the mold to an elevated temperature of disposing a body of carbon-bearing material within the confines of the furnace, and practicing the process step subsequent to heating the mold to an elevated temperature, forming carbon monoxide in the inert carrier gas by reacting the carbon-bearing material with the oxygen-bearing gas in the prevailing atmosphere introduced into the furnace.

22. The method of claim 18 wherein the oxygen-bearing gas is carbon monoxide.

23. The method of claim 2 wherein the prevailing atmosphere is a gas selected from the group consisting of hydrogen and hydrogen containing a predetermined amount of water vapor therein.

* * * * *

Disclaimer 4,031,945.—*Michael F. X. Gigliotti, Jr.*, Scotia; and *Charles D. Greskovich*, Schenectady, N.Y. PROCESS FOR MAKING CERAMIC MOLDS HAVING A METAL OXIDE BARRIER FOR CASTING AND DIRECTIONAL SOLIDIFICATION OF SUPERALLOYS. Patent dated June 28, 1977. Disclaimer filed July 28, 1980, by the assignee, *General Electric Company*.

Hereby enters this disclaimer to claims 19, 20, 21 and 22 of said patent. [*Official Gazette September 16, 1980.*]